United States Patent [19]

Bradley: Hugh T.

[11] Patent Number: 4,794,500

[45] Date of Patent: Dec. 27, 1988

[54] COMPOSITE HEADLAMP BULB RETAINING MECHANISM

[75] Inventor: Bradley: Hugh T., Farmington Hills, Mich.

[73] Assignee: Ford Motor Company, Dearborn, Mich.

[21] Appl. No.: 50,803

[22] Filed: May 18, 1987

[51] Int. Cl.[4] ..... H01R 33/00

[52] U.S. Cl. ..... 362/226; 362/61; 362/267

[58] Field of Search ..... 362/226, 267, 61, 211

[56] References Cited

U.S. PATENT DOCUMENTS

| | | | |
|---|---|---|---|
| 1,027,306 | 5/1912 | Avery | 362/267 |
| 2,233,486 | 12/1939 | Portnow . | |
| 2,265,446 | 12/1941 | Poglein | 362/310 |
| 2,748,255 | 5/1956 | Decker . | |
| 2,750,491 | 6/1956 | Anderson | 362/267 |
| 2,992,323 | 7/1961 | Fletcher | 362/226 |
| 3,885,149 | 5/1975 | Wolfe et al. | 313/318 |
| 4,019,045 | 4/1977 | Bassett . | |
| 4,100,448 | 7/1978 | Chipner et al. . | |
| 4,305,016 | 12/1981 | Schmidt . | |
| 4,427,255 | 1/1984 | Cox | 362/296 |
| 4,500,946 | 2/1985 | Mikola | 439/680 |
| 4,513,356 | 4/1985 | Mikola | 362/226 |
| 4,528,619 | 7/1985 | Dolan et al. | 362/267 |
| 4,563,730 | 7/1986 | Saito | 362/267 |
| 4,569,005 | 2/1986 | Bergin et al. | 362/267 |
| 4,569,006 | 2/1986 | Bergin et al. | 362/267 |
| 4,590,542 | 5/1986 | Schauwecker et al. | 362/61 |
| 4,622,486 | 11/1986 | Endo | 313/115 |
| ∝,623,958 | 11/1986 | Van der Linde et al. | 362/267 |
| 4,631,651 | 12/1986 | Bergin et al. | 362/211 |
| 4,679,128 | 7/1987 | Van Duyn | 362/226 |
| 4,682,274 | 7/1987 | Freudenreich et al. | 362/267 |

OTHER PUBLICATIONS

Drawing Dated 12/8/86, Koito Mfg. Co. Ltd.

*Primary Examiner*—Ira. S. Lazarus
*Assistant Examiner*—Sue Hagarman
*Attorney, Agent, or Firm*—Paul K. Godwin, Jr.; Clifford L. Sadler

[57] ABSTRACT

For a composite headlamp bulb body that has a seal and a flange with spaced tabs extending therefrom, the mechanism allows for the bulb body to be oriented in a predetermined configuration and inserted into the aperture of a retaining ring. The retaining ring is snap fitted for permanent installation onto the socket structure of a reflector housing and contains cantilevered finger elements with ramped surfaces to interfere with the flange tabs during rotation of the inserted bulb while in the socket.

10 Claims, 2 Drawing Sheets

COMPOSITE HEADLAMP BULB RETAINING MECHANISM

BACKGROUND OF THE INVENTION

1. Field of the Invention

The present invention is directed to the field of lighting components and more specifically to the area of retaining mechanisms for composite headlamp bulbs installed in reflector housings.

2. Description of the Prior Art

In commonly assigned U.S. Pat. No. 4,513,356, a retaining mechanism was described as surrounding both the base flange of a bulb body and a socket opening and locking the bulb body in the socket. The specific embodiment shown in that patent included a threadable collar device with a central aperture for surrounding the bulb body and cantilevered tabs that extended radially inward to compress against the flange when the collar was tightened onto corresponding thread paths formed on the outside of the socket. That mechanism has been widely adopted among manufacturers of composite headlamps utilizing the cylindrical bulb body illustrated in that patent, as well as commonly assigned U.S. Pat. No. 4,500,946.

More recently, another bulb has become available for use which has a body that is formed with a right angle bend to accommodate an electrical connection that is made transverse to the light axis. This serves to reduce the necessary clearance formerly provided behind the lamp. Such a bulb is illustrated in U.S. Pat. No. 4,631,651, without a described retaining mechanism.

SUMMARY OF THE INVENTION

The present invention provides a retaining mechanism for use with several types of bulbs, but is specifically shown for retaining the type of bulb body described in U.S. Pat. No. 4,631,651, and noted above.

In combination with a socket opening extension from the reflector housing, an apertured retaining ring is key positioned and snapped onto the socket extension structure and functions to receive and retain the flanged bulb body. The flange on the bulb body is configured to have a plurality of tabs extending from its periphery at predetermined positions. The aperture of the retaining ring is configured to be sufficiently large enough that the flange of the bulb body and its tabs may be inserted through the aperture when properly aligned and oriented. After insertion, the flanged bulb body is rotated through a defined angle and the tabs slide beneath a set of cantilevered retaining fingers that circumferentially extend into the ring aperture, where the flange is thereafter retained against the socket opening in a sealed condition to prevent movement or accidental removal from the socket.

The present invention also provides for removal of the flanged bulb body from the retaining ring by overcoming the friction of the retaining fingers on the flange tabs to rotate the bulb body in the opposite direction through the same angle and axially withdrawing the bulb body from the socket through the aperture of the retaining ring.

It is therefore, an object of the present invention to provide a retaining mechanism for composite headlamps that incorporates a retaining ring fixedly attached to the socket structure into which the bulb is to be inserted.

It is another object of the present invention to provide a retaining ring that is self-latching onto the socket structure so as to eliminate the need for installation tools.

It is a further object at the present invention to provide a keying mechanism whereby the retaining ring can only be latched onto the socket structure in a single orientation and the flanged bulb body can only be inserted into the aperture of the ring in a single orientation and rotated to a second single orientation for retention.

DETAILED DESCRIPTION OF THE PREFERRED EMBODIMENT

Figure 1:
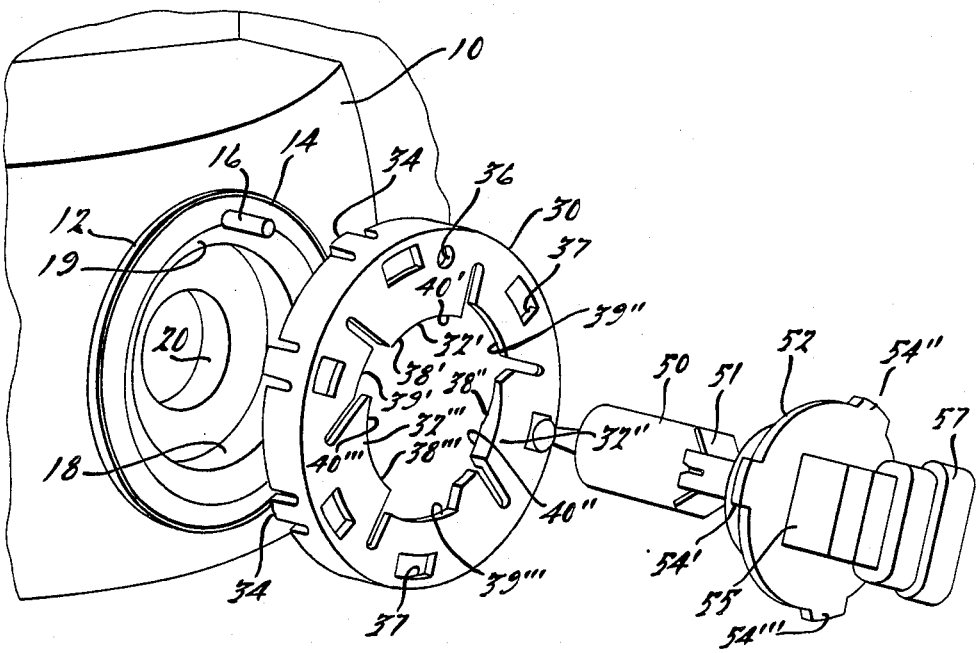
FIG. 1 is an exploded perspective view of the preferred embodiment of the present invention.
Figure 2:
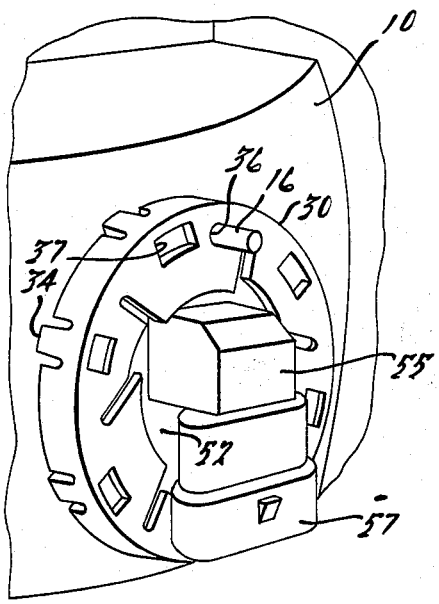
FIG. 2 is a perspective view of the preferred embodiment shown in a fully assembled configuration.
Figure 3:
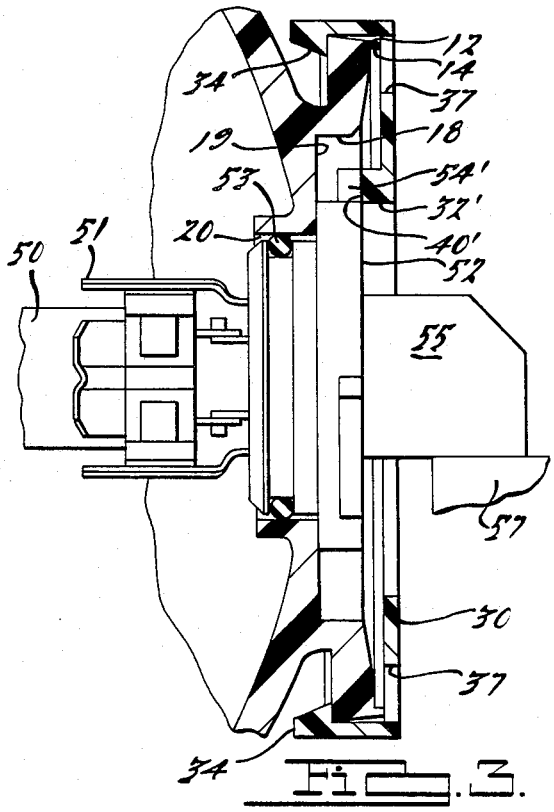
FIG. 3 is a partial cross sectional plan view of the preferred embodiment shown in FIG. 2.
Figure 4:
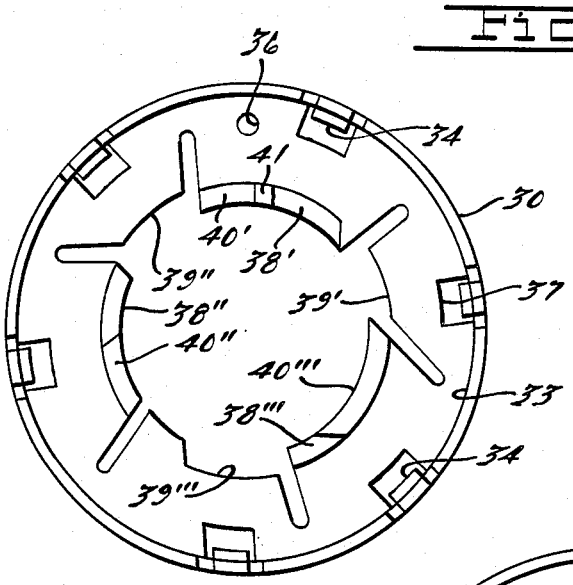
FIG. 4 is an underside view of the retaining ring utilized in the preferred embodiment.

In FIG. 1, a sealable reflector housing 10 is shown having a socket aperture 20 and associated structure formed therein to receive an O-ring sealable bulb body therein. The socket structure forming the aperture 20 includes a circular sidewall of a diameter appropriate for receiving and compressing the O-ring 53 on the body 55 of bulb 50. A larger diametered opening 18 is shown as being concentric with the socket aperture 20 and serves to define the seating surface 19 intermediate thereof. The seating surface 19 is that surface to which the flange 52 of the bulb body 55 is compressed against by the retaining ring 30 when the bulb body is inserted and rotated for locking. A flange 12 is formed to extend outward from sidewall 18 and is raised from the housing 10 to provide a gripping edge for the retaining ring 30 (see FIG. 3).

The bulb 50 is shown in FIG. 1 as supported in a bulb body 55 by a clip element 51. The bulb preferrably contains one or more filaments that are electrically connected through the body 55 to an electrical connector 57 located at the opposite end of the body 55. (Details of the internal electrical connections and support clip element are described in the prior art and are not described herein.) The body 55 is formed to have a right angle bend so that electrical connections are made at connector 57, transverse to the socket axis.

The body 55 also contains a substantially circular flange 52 and a plurality of tabs 54', 54'' and 54''' radially extending therefrom. In the preferred embodiment, the flange tabs 54', 54'' and 54''' are inconsistently sized so that the bulb body 55 may be inserted in the socket in a single orientation. Such a single orientation feature is extremely important in the situation where the present invention is employed in automotive headlamp applications. In such applications, there is a strict requirement that the filaments of the bulbs be precisely oriented and potioned within their associated reflectors to provide a prescribed lighting pattern.

With common reference to FIGS. 1–6, the retaining ring is now described. The retaining ring 30 is preferrably formed of a molded plastic material so that its aligning and locking features may be combined in a unitary structure. The retaining ring 30 is circular cup shaped with an cylindrical side wall 33 having an inner diameter that is slightly larger than the diameter of the raised flange 12 on the reflector housing 10. A plurality of ramped catch barbs 34 are formed to coextend from the side wall 33. The ramp portions of the catch barbs 34 extend inside the inner diameter dimension of the side wall 33 so as to contact the outer lip 14 adjacent the raised flange 12, when installed thereon.

An alignment hole 36 is located on the retaining ring 30 to coincide with the alignment pin 16 extending from the socket structure on the reflector housing 10. Therefore, when the retaining ring 30 is installed on the housing 10, the pin 16 is first aligned with the alignment hole 36. Secondly, the ramps of the catch barbs 34 are each positioned to contact the outer lip 14 and the ring is axially forced against the housing 10 until all the catches 34 snap in place behind the raised flange 12. At this point, the retaining ring is permanently installed on the housing 10 and is only removable if several of the catches 34 are forced outwardly from the raised flange 12.

The retaining ring 30 contains a generally circular aperture that is axially aligned with the socket aperture 20 and has a clearance diameter defined by projecting cantilevered finger elements 32', 32'' and 32'''. The clearance diameter is sized to allow the flange 52 of the bulb body 55 pass through, unobstructed.

The respective cantilevered finger elements 32', 32'' and 32''' contain ramped surfaces 38', 38'' and 38''' on the socket side of the ring 30, opposite the insertion direction of the bulb body 55. The ramped surfaces extend sufficiently towards the seating surface 19 so that the distance therebetween is less than the thickness of the flange tabs 54', 54'' and 54''' of the bulb body 55. Compression surfaces 40', 40'' and 40''' are also formed adjacent the ramped surfaces on the respective cantilevered finger elements 32', 32'' and 32''' so as to provide continuous holding of the flange tabs 54', 54'' and 54''' against the seating surface 19, when the bulb body 55 is installed.

Figure 5:
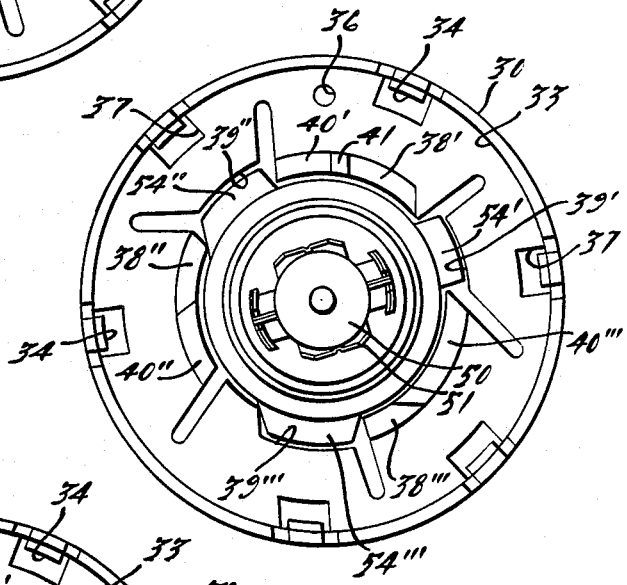
FIG. 5 is an underside view of the retaining ring shown in FIG. 4 with the flanged bulb body oriented for insertion from the opposite side.

When viewed in FIG. 5 from the socket side of the retaining ring 30 with the bulb body 55 oriented for insertion throught the central aperture, the flange tab 54' is oriented to pass through the space 39' defined between cantilevered finger elements 32' and 32'''. Similarly, spaces 39'' and 39''' are also provided to respectively pass flange tabs 54'' and 54'''. As mentioned above, the flange tabs are of various sizes to insure a predetermined orientation. Consequently, the spaces between the cantilevered finger elements are of corresponding sizes to profile the flange 52 and its tabs in order to thereby allow the flange 52 and all the tabs to pass through the aperture of the retaining ring 30 when the bulb body 55 is in its proper orientation and alignment with respect to the socket.

Figure 6:
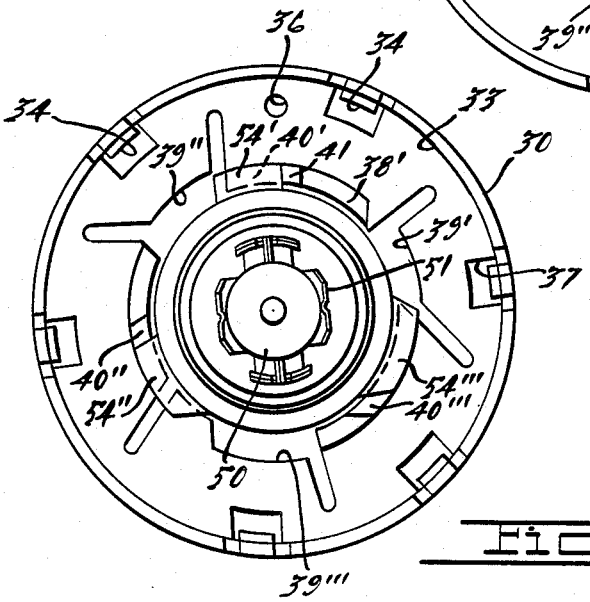
FIG. 6 is an underside view of the retaining ring shown in FIG. 4 with the inserted flanged bulb body rotated to its fully locked position.

As can be seen from FIG. 6, when the inserted bulb body 55 is rotated through a predetermined angle, the tabs 54', 54'' and 54''' cause cantilevered finger elements 32', 32'' and 32''' to be deflected away from the socket. When tab 54' is rotated past an antirotation surface 41, between ramp surface 38' and compression surface 40', the tab 54' (and the entire bulb body 55) is frictionally held to prevent accidental rotation from that position.

Of course, when removal of the bulb body 55 is desired, it is only necessary to rotate the bulb body 55 in a counter-clockwise direction after overcoming the friction interference caused by the antirotation surface 41 against tab 54'.

It will be apparent that many modifications and variations may be made to the invention disclosed herein without departing from the overall inventive concepts embodied therein. Therefore, all such modifications and variations are intended to be covered by the appended claims.

I claim:

1. A retaining mechanism for a composite headlamp bulb comprising:

a headlamp reflector housing that contains an integral socket structure with an aperture for accepting said composite headlamp bulb;

a retaining ring containing integral locking elements for providing a permanent snap fit to said socket structure, a central aperture aligned with said socket aperture for accepting the insertion of said composite headlamp bulb and a plurality cantilevered elements configured to hold said composite headlamp bulb in said socket when inserted therein.

2. A mechanism for retaining a flanged composite headlamp bulb in a reflector housing that contains an integral socket structure with an aperture for accepting said composite headlamp bulb comprising: a retaining ring containing integral locking elements for providing a permanent snap fit to said socket structure, a central aperture aligned with the aperture of said socket structure for accepting the insertion of said flanged composite headlamp bulb and a plurality cantilevered elements configured to hold said flange of said composite headlamp bulb in said socket, when inserted therein.

3. A mechanism as in claim 2, wherein said flange of said composite headlamp bulb contains a plurality of tabs extending outwardly of its periphery and said cantilevered elements of said retaining ring are spaced apart by an amount that allows said tabs on said bulb flange to pass through, when inserted therein.

4. A mechanism as in claim 3, wherein said socket structure contains an outwardly extending flange structure concentric with said socket aperture and said locking elements of said retaining ring are disposed about the periphery of said retaining ring to interfere with said socket structure flange when said ring is aligned therewith and forced on said socket structure.

5. A mechanism as in claim 4, wherein said locking elements of said retaining ring contain barbed elements that capture the opposite side of said socket flange structure when said ring is forced onto said socket structure a predetermined distance.

6. A mechanism as in claim 5, wherein said socket structure and said retaining ring contain complementary means for aligning said retaining ring with respect to said socket structure aperture prior to engaging said locking elements against said socket structure.

7. A mechanism as in claim 6, wherein said complementary aligning means includes a pin element and a correspondingly sized hole on said socket structure and said retaining ring, respectively.

8. A mechanism as in claim 7, wherein said socket structure contains said pin element aligned parallel with the socket aperture and said retaining ring contains a correspondingly sized hole to accept said pin element when the two are axially aligned.

9. A mechanism as in claim 3, wherein said retaining ring is permanently mounted on said socket structure and said cantilevered elements contain ramped surfaces disposed to interfere with the rotation of said tabs extending from the flange of said headlamp bulb body when inserted in said socket aperture.

10. A mechanism as in claim 9, wherein said cantilevered elements of said retaining ring also contain compression surfaces adjacent said ramped surfaces that provide friction to hold said tabs extending from the flange of said headlamp bulb body when inserted in said socket aperture and rotated to coincide therewith.

* * * * *